US008029338B2

(12) United States Patent
Kumar et al.

(10) Patent No.: US 8,029,338 B2
(45) Date of Patent: Oct. 4, 2011

(54) GRINDING WHEEL FOR ROLL GRINDING APPLICATION AND METHOD OF ROLL GRINDING THEREOF

(75) Inventors: Kris V. Kumar, Columbus, OH (US); Biju Varghese, Westerville, OH (US)

(73) Assignee: Diamond Innovations, Inc., Worthington, OH (US)

( * ) Notice: Subject to any disclaimer, the term of this patent is extended or adjusted under 35 U.S.C. 154(b) by 359 days.

(21) Appl. No.: 10/596,710

(22) PCT Filed: Mar. 8, 2004

(86) PCT No.: PCT/US2004/007071

§ 371 (c)(1),
(2), (4) Date: Jun. 22, 2006

(87) PCT Pub. No.: WO2005/068099

PCT Pub. Date: Jul. 28, 2005

(65) Prior Publication Data

US 2007/0099548 A1 May 3, 2007

Related U.S. Application Data

(60) Provisional application No. 60/532,321, filed on Dec. 23, 2003.

(51) Int. Cl.
*B24B 1/00* (2006.01)

(52) U.S. Cl. ..... 451/49; 451/58

(58) Field of Classification Search ..... 451/11, 451/8, 9, 49, 283, 548, 57, 58; 148/400, 148/320

See application file for complete search history.

(56) References Cited

U.S. PATENT DOCUMENTS

| | | | | | |
|---|---|---|---|---|---|
| 1,904,044 | A | | 4/1933 | Guild | |
| 3,653,161 | A | | 4/1972 | Clark, Jr. | |
| 3,653,162 | A | * | 4/1972 | Clark, Jr. | 451/4 |
| 3,660,947 | A | * | 5/1972 | Clark, Jr. | 451/4 |
| 3,664,066 | A | * | 5/1972 | Clark, Jr. | 451/4 |
| 3,739,533 | A | * | 6/1973 | Iida et al. | 451/1 |
| 3,747,584 | A | * | 7/1973 | Kikuchi | 125/11.03 |
| 4,186,529 | A | * | 2/1980 | Huffman | 451/4 |
| 4,339,895 | A | * | 7/1982 | Fivian | 451/47 |
| 4,555,873 | A | * | 12/1985 | Smith | 451/21 |
| 4,716,687 | A | * | 1/1988 | Tsukamoto et al. | 451/49 |
| 4,905,418 | A | * | 3/1990 | Wedeniwski | 451/5 |

(Continued)

FOREIGN PATENT DOCUMENTS

EP 0344610 12/1989

(Continued)

OTHER PUBLICATIONS

Reinhold, Clausnitzer, "Grinding: Fundamentals and Indepth Information", VEB Verlag Technik Berlin, 1988.

(Continued)

*Primary Examiner* — Timothy V Eley
(74) *Attorney, Agent, or Firm* — Maria C. Gasaway

(57) ABSTRACT

Iron and steel rolls are ground to production quality requirements with a grinding wheel that requires minimal wheel wear compensation, profile error compensation or taper error compensation during the grinding process. The grinding wheel consists essentially of a superabrasive material selected from the group of natural diamond, synthetic diamond, cubic boron nitride, and mixtures thereof, in a bond system, for a grinding wheel with extended wheel life, and which removes minimum amount of stock off the roll to achieve desired roll geometry.

16 Claims, 7 Drawing Sheets

Infeed method for CBN wheels

U.S. PATENT DOCUMENTS

| | | | | | |
|---|---|---|---|---|---|
| 4,989,375 | A | * | 2/1991 | Henmi et al. | 451/550 |
| 5,006,685 | A | * | 4/1991 | Hatano et al. | 219/69.2 |
| 5,025,547 | A | * | 6/1991 | Sheu et al. | 29/527.4 |
| 5,177,901 | A | * | 1/1993 | Smith | 451/72 |
| 5,203,886 | A | | 4/1993 | Sheldon et al. | |
| 5,390,518 | A | * | 2/1995 | Morimoto et al. | 72/8.2 |
| 5,401,284 | A | | 3/1995 | Sheldon et al. | |
| 5,536,283 | A | | 7/1996 | Sheldon et al. | |
| 5,562,525 | A | | 10/1996 | Mori et al. | |
| 5,569,060 | A | * | 10/1996 | Mori et al. | 451/5 |
| 5,863,308 | A | | 1/1999 | Qi et al. | |
| 5,954,565 | A | | 9/1999 | Mori et al. | |
| 5,957,756 | A | * | 9/1999 | Figge et al. | 451/49 |
| 6,106,373 | A | * | 8/2000 | Fabris | 451/57 |
| 6,220,949 | B1 | | 4/2001 | Hayashi et al. | |
| 6,248,003 | B1 | * | 6/2001 | Hoshiya et al. | 451/56 |
| 6,306,007 | B1 | * | 10/2001 | Mori et al. | 451/5 |
| 6,450,861 | B2 | | 9/2002 | Mori et al. | |
| 6,585,558 | B1 | | 7/2003 | Mori et al. | |
| 6,616,511 | B2 | * | 9/2003 | Mori et al. | 451/49 |
| 6,988,933 | B2 | * | 1/2006 | Yoritsune et al. | 451/5 |
| 6,988,937 | B2 | * | 1/2006 | Bonner et al. | 451/49 |
| 2002/0009950 | A1 | * | 1/2002 | Mori et al. | 451/8 |
| 2002/0052168 | A1 | * | 5/2002 | White | 451/5 |
| 2003/0194954 | A1 | * | 10/2003 | Bonner et al. | 451/49 |
| 2005/0081592 | A1 | * | 4/2005 | Sambuco et al. | 72/236 |
| 2005/0115156 | A1 | * | 6/2005 | Yasuoka et al. | 51/298 |

FOREIGN PATENT DOCUMENTS

| | | |
|---|---|---|
| EP | 0573035 | 12/1993 |
| JP | 57-156156 | 9/1982 |
| JP | 4201171 | 7/1992 |
| JP | 05-057583 | 3/1993 |
| JP | 06-226606 | 8/1994 |
| JP | 07-195255 | 8/1995 |
| JP | 11-077532 | 3/1999 |
| JP | 2002-059205 | 2/2002 |
| JP | 2003-001307 | 1/2003 |
| JP | 2003-010908 | 1/2003 |

OTHER PUBLICATIONS

Walzen Irle GmbH, Conversion table for roller hardness, Date unknown.
Prospekt Maschinenfabrik Herkules, "Cylindrical Surface Grinding with CBN Grinding Wheels", Date unknown.
Herkules Hans Thoma Company, with limited liability Machine Plant, Excerpt from the Trade Register, Date unknown.
Tyrolit Company, Data Sheet, Nov. 1996.
Hermes Slipverktyg AB, Order certificate for grinding wheel, Sep. 2003.
Hermes Slipverktyg AB, Delivery certificate for grinding wheel, Sep. 2003.
Hermes Slipverktyg AB, Order certificate for grinding wheel, Nov. 2007.
Hermes Slipverktyg AB, Grinding wheel sticker for the grinding wheel produced as per order certificate for grinding wheel, Nov. 2007.
Erdmann Knosel, Trial Report, Dresden Technical University, Date unknown.
Element Six, ABN Cubic Boron Nitride Abrasives Prospectus, Date unknown.
Hermes Schleifkorper GmbH, Order and invoice regarding a delivery of CBN grinding grain, Jul. 2003.
Internet Search on "Konizitatstoleranz" (taper tolerance), Printed Sep. 18, 2008.
Wendt GmbH application highlight Data Sheet, Grinding a hard alloy coated shaft Mar. 22, 2001.
Wendt GmbH, Distribution List, Jun. 25, 2001.
TEW Krefeld Trip Report, Jul. 20, 1989.
Stora-Feldmuhle-Hyltebruck Trip Report, May 12, 1992.

* cited by examiner

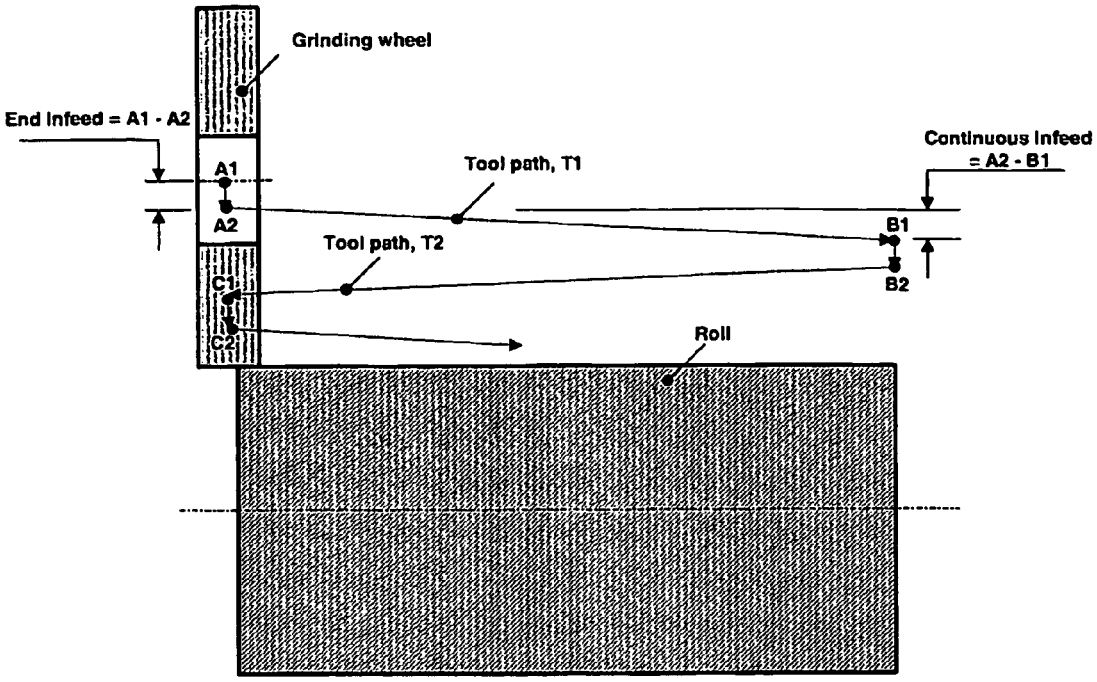
Fig 4 A - Infeed method for conventional wheels
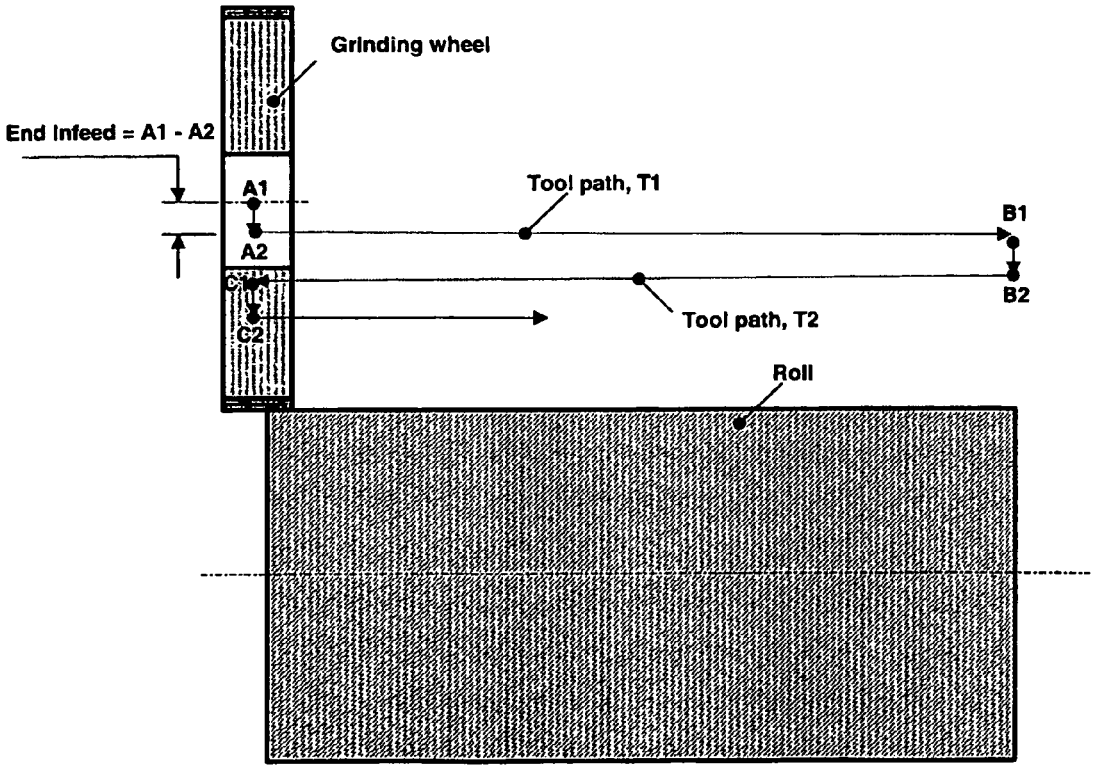
Fig 4 B - Infeed method for CBN wheels

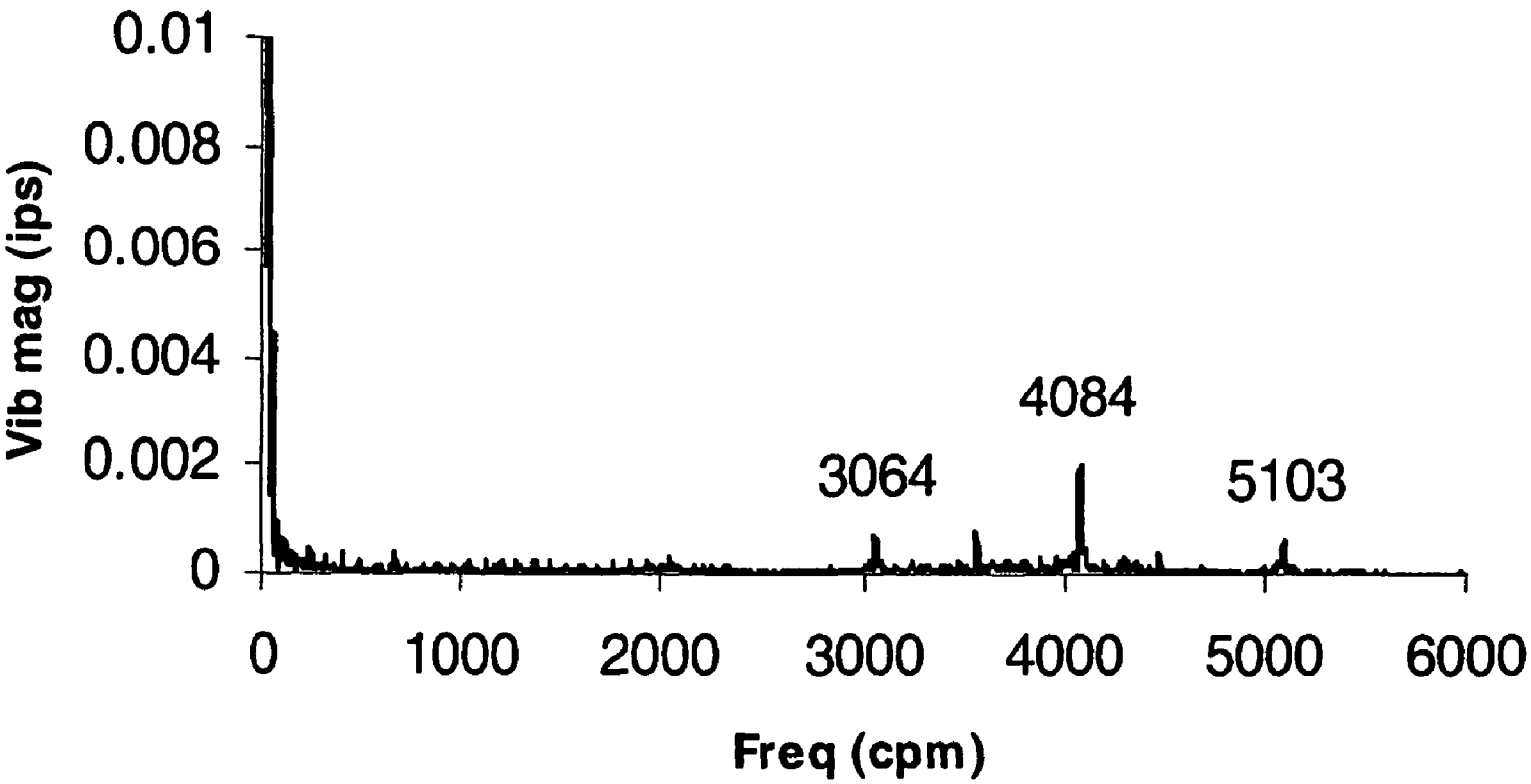
Fig. 5A - Wheel speed = 942 rpm

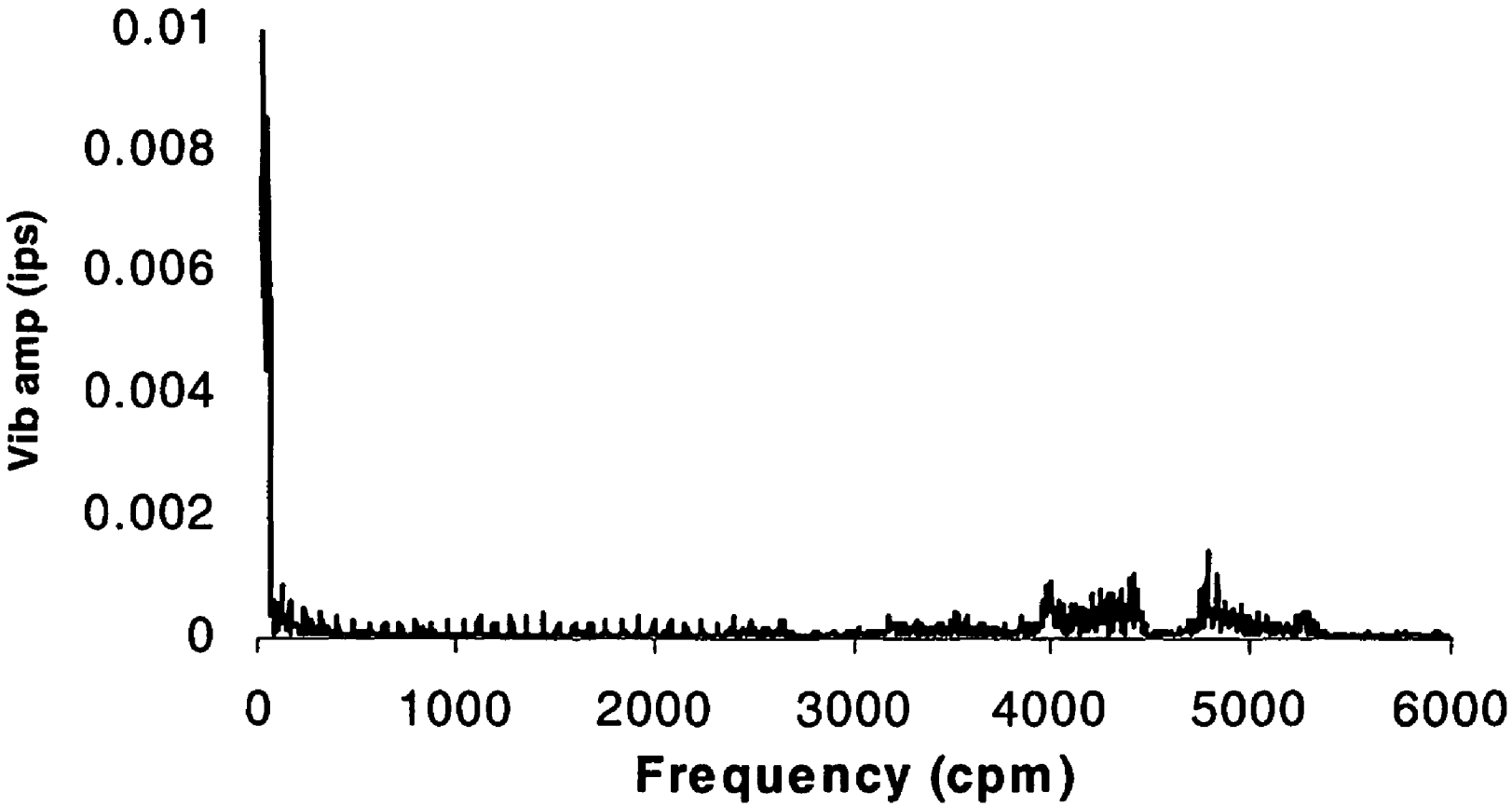
Fig. 5B - Wheel speed = 942 rpm +/ - 47 rpm

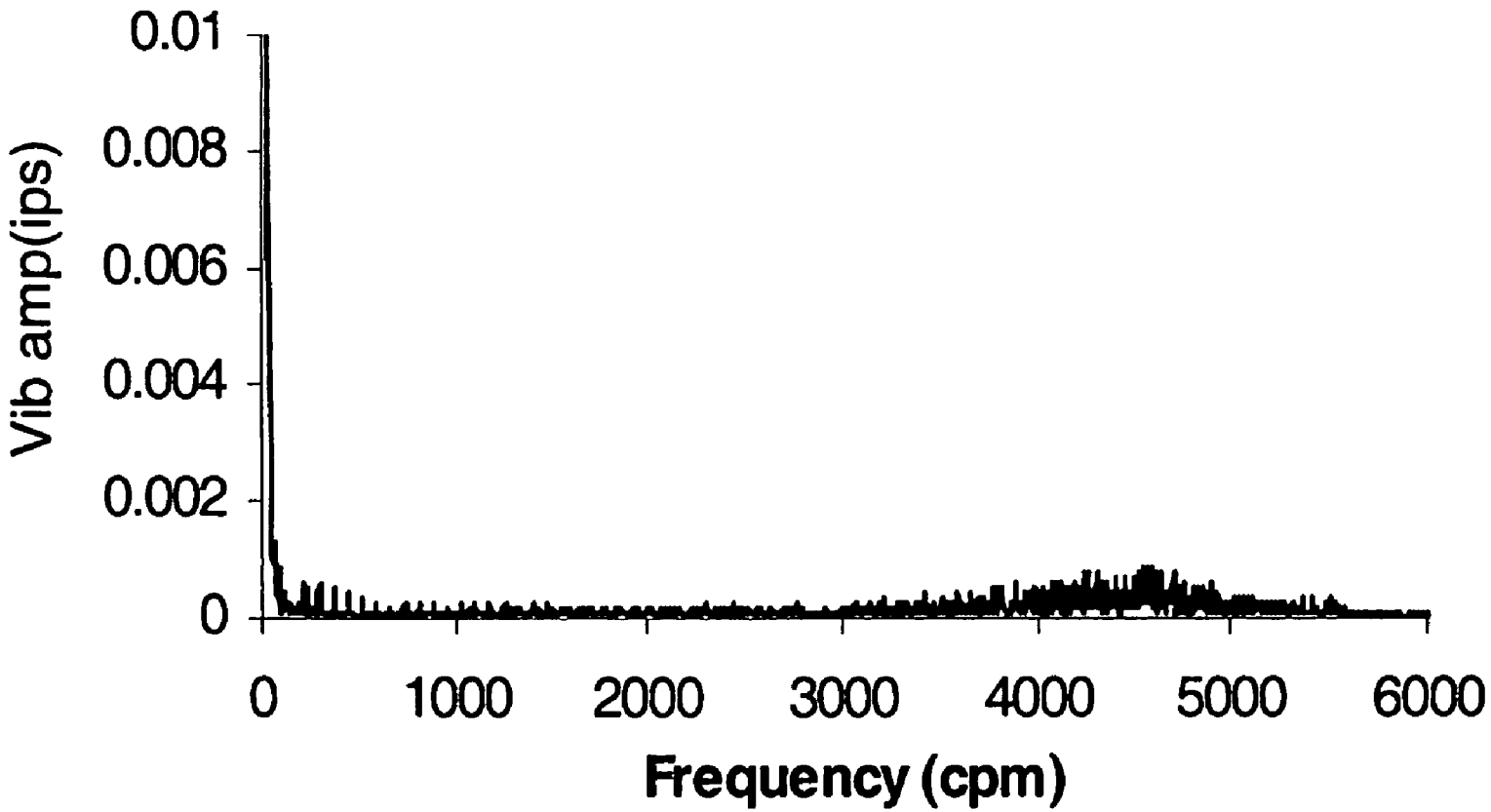
Fig. 5C - Wheel speed = 942 rpm +/- 94 rpm

GRINDING WHEEL FOR ROLL GRINDING APPLICATION AND METHOD OF ROLL GRINDING THEREOF

RELATED APPLICATIONS AND CLAIM OF PRIORITY

This application is the U.S. national phase of PCT/US2004/07071, filed Mar. 8, 2004, which claims priority to, U.S. provisional patent application No. 60/523,321, filed Dec. 23, 2003, herein incorporated by reference in its entirety.

TECHNICAL FIELD

The present invention relates to a grinding wheel for use in ferrous roll grinding applications and a method to regrind rolls to desired geometrical quality. The invention also relates to grinding wheels comprising cubic boron nitride as the primary abrasive in a bond system.

BACKGROUND OF THE INVENTION

Rolling is a forming process used to produce strips, plates or sheets of varying thickness in industries such as the steel, aluminum, copper and paper industries. Rolls are made to varying shapes (profiles) with specific geometric tolerances and surface integrity specifications to meet the needs of the rolling application. Rolls are typically made out of iron, steel, cemented carbide, granite, or composites thereof. In rolling operations, the rolls undergo considerable wear and changes in surface quality and thus require periodic re-shaping by machining or grinding, i.e., "roll grinding," to bring the roll back to the required geometric tolerances while leaving the surface free of feed lines, chatter marks and surface irregularities such as scratch marks and/or thermal degradation of the roll surface. The rolls are ground with a grinding wheel traversing the roll surface back and forth on a dedicated roll grinding machine (off-line) or as installed in a strip rolling mill with a roll grinding apparatus (on-line) attached to the roll stand in a mill.

The challenge with both of these methods is to restore the roll to its correct profile geometry with minimum stock removal and without visible feed marks, visible chatter marks or surface irregularities. Feed lines or feed marks are imprints of the wheel leading edge on the roll surface corresponding to the distance the wheel advances per revolution of the roll. Chatter marks correspond to wheel-work contact lines that occur periodically on the circumference of the roll either due to wheel run out error or due to vibrations that arise from multiple sources in the grinding system such as grinding wheel imbalance, spindle bearings, machine structure, machine feed axes, motor drives, hydraulic and electrical impulses. Both feed marks and chatter marks are undesirable in the roll, as they affect the durability of the roll in service and produce an undesirable surface quality in the finished product. Surface irregularities in the roll are associated with either a scratch mark and/or thermal degradation of the working surface of the roll following grinding. Scratch marks are caused by either loose abrasive particles released from the wheel or grinding swarf material scratching the roll surface in a random manner. A visual inspection of the roll is normally used depending on the application to accept or reject the roll for scratch marks. Thermal degradation of the roll surface is caused by excessive heat in the grinding process resulting in a change in the microstructure of the roll material at or near the ground surface and/or sometimes resulting in cracks in the roll. Eddy current and ultrasonic inspection methods are employed to detect thermal degradation in the rolls following grinding.

Typically for an off-line roll grinding method, a grinding machine is equipped such that the grinding wheel rotational axis is parallel to the work roll rotational axis and the rotating wheel in contact with the rotating roll surface is traversed along the axis of the roll back and forth to produce the desired geometry. Roll grinding machines are commercially available from a number of vendors that supply equipment to the roll grinding industry including Pomini (Milan, Italy), Waldrich Siegen (Germany), Herkules (Germany), and others. The grinding wheel shape used in off-line roll grinding is typically a Type 1 wheel, wherein the outer diameter face of the wheel performs grinding.

It is common practice in the roll grinding industry to grind iron and steel roll materials with grinding wheels comprising conventional abrasives such as aluminum oxide, silicon carbide, or mixtures thereof, along with fillers and secondary abrasives in an organic bonded resin wheel system, e.g., a shellac type resin or a phenolic resin matrix. It is also known in the industry to use diamond as the primary abrasive in a grinding wheel made with a phenolic resin bonded matrix to grind roll materials made of cemented carbide, granite or non-ferrous roll materials. Inorganic bonded or vitrified or ceramic bonded abrasive wheels have not been successful in roll grinding applications compared to organic resin bonded wheels, because the former has a low impact resistance and low chatter resistance compared to the latter. The organic resin bonded wheels are known to work better in roll grinding applications because of their low E-modulus (1 GPa-12 GPa) compared to inorganic vitrified bond wheels, which have a higher E-modulus (18 GPa-200 GPa). Another problem associated with the vitrified bonded conventional wheel system is that its brittle nature causes the wheel edge to break down during the grinding process, resulting in scratch marks and surface irregularities in the work roll.

U.S. Patent Application Publication No. 20030194954A1 discloses roll grinding wheels consisting essentially of conventional abrasives such as aluminum oxide abrasive or silicon carbide abrasive and mixture thereof, agglomerated with selected binder and filler materials in a phenolic resin bond system to give improved grinding wheel life over a shellac resin bond system. In the examples, a cumulative grinding ratio G of 2.093 after grinding 19 rolls is demonstrated, representing an improvement of 2-3 times the G observed for shellac resin bonded wheels. The grinding ratio G represents the ratio of volume of roll material removed to the volume of wheel worn. The higher the value of G, the longer the wheel life. However, even with these improved grinding wheels the rate of grinding wheel wear is still quite large in grinding steel rolls, that continuous radial wheel wear compensation (WWC) is employed during the grind cycle to meet geometrical taper tolerances (TT) in the roll. In the art, taper tolerance TT corresponds to the allowable size variation in the roll from one end of the roll to the other end. WWC is done by continually moving the grinding wheel feed axis into the roll surface as a function of the axial traverse of the wheel. The requirement of WWC in roll grinding dictates the need for sophisticated machine controls as well as added complexity to the grinding cycle.

There is a second disadvantage with the grinding wheels employing conventional abrasives of the prior art. The wheels undergo rapid wheel wear during the roll grinding process, requiring multiple corrective grinding passes to generate both a roll profile and taper within the desired tolerance, which is typically less than 0.025 mm. These additional grinding passes result in the removal of expensive roll material, leading to a reduction in the useful work roll life. Typically in the prior art, the ratio TT/WWC ranges from 0.5 to 5 (where TT and WWC are expressed in consistent units) to meet roll specifications with conventional abrasives. A higher ratio of TT to WWC is particularly desirable to maximize the useful roll life and grinding wheel life, and thus improve the efficiency of the roll grinding process.

The third disadvantage of corrective grinding passes is increased cycle time, thus reducing the productivity of the process. Loss of productive time also occurs due to frequent wheel changes that result from accelerated wear of the organic resin bonded wheels. Yet a fourth disadvantage faced with conventional abrasive wheels is that the useful wheel diameter typically decreases from 36-24 inches (914-610 mm) over the life of the wheel, the compensation for which can result in a large cantilever action of the grinding spindle head. The continuous increase in cantilever action results in continually changing stiffness of the grinding system, causing inconsistencies in the roll grinding process.

A number of other prior art references, i.e., European patent documents EP03444610 and EP0573035 and U.S. Pat. No. 5,569,060 and U.S. Pat. No. 6,220,949, disclose an on-line roll grinding method, Japan patent document JP06226606A discloses an off-line roll grinding apparatus and operation, wherein a planar disk face wheel (a cup face wheel) Type-6A2 is used to grind the roll. The grinding wheel axis in this type of grinding system is perpendicular to work roll axis, such that the axial side face (working face) of the wheel is pressed with a constant force in frictional sliding contact with the outer circumferential roll surface. In this design, the wheel spindle axis is tilted slightly so that contact with the work roll surface occurs on the leading face of the wheel. The grinding wheel in this method is either passively driven with the aid of torque of the work roll, or positively driven by a grinding spindle motor.

In another prior art reference, European Patent document EP 0344610 discloses a cup face wheel used in on-line roll grinding having two abrasive annular ring members integrally bonded, wherein the wheels comprise aluminum oxide, silicon carbide, CBN or diamond abrasives in two different bonding systems such as organic or inorganic bond system for each abrasive member respectively. The vitrified bonded abrasive layer (having higher E-modulus 19.7-69 GPa) is the inner ring member; and the outer ring member is made with an organic resin bonded system (lower E-modulus 1-9.8 GPa) to avoid chipping and cracking of the wheel. As the rates of grinding wheel wear are not the same for the two members of different bonding systems, profile errors, chatter and scratch marks may frequently be experienced in grinding the roll.

U.S. Pat. Nos. 5,569,060 and 6,220,949 disclose a cup face phenolic resin bonded CBN wheel with different flexible wheel body design to absorb the heavy vibrations induced in the rolling mill stands while grinding the work roll. With a flexible wheel body design herein, the contact force between the wheel face and roll surface is typically controlled at a constant magnitude (between 30-50 kgf/mm width of the grinding wheel face) during the grinding process to achieve uniform contact along the working wheel face.

This type of flexible wheel design is also applied in the off-line grinding method disclosed in Japan patent publication JP06226606A. Grinding with a constant wheel flexure or a constant wheel load with a cup face grinding wheel means that the material removal rate depends on the sharpness of the wheel and the type of roll material that is being ground. Since the wear on the work roll in the mill operation is not always uniform, it can be very challenging when the work roll wear is large (in excess of 0.010 mm) as non-uniform contact between the cup wheel face and the roll surface develops. This results in uneven wheel wear, affecting the cutting ability or the sharpness of the wheel along its working face, causing uneven stock removal in the work roll along its axial length and resulting in profile errors and chatter in the process.

A stable grinding process with a cup face CBN grinding wheel is then possible by frequently grinding the rolls and correcting the surface irregularities before a large wear amount develops on the roll. With this approach it is conceivable that the ratio TT/WWC can be increased beyond 10 compared to the conventional abrasive Type1 wheel that is used in the off-line grinding method. A limiting factor of the cup face wheel design, however, is that it can present considerable challenge and difficulty in keeping the ratio TT/WWC greater than 10 when grinding rolls of various shapes such as a convex crown, concave crown or a continuous numerical profile along the axis of the roll.

The off-line and on-line roll grinding methods offer two different approaches to resurface the work rolls and back up rolls with their different kinematic arrangements and grinding process strategies. The grinding article used in the off-line method is used to grind a single work roll material specification, or more often multiple work roll material specifications such as iron, high speed steel-HSS, high chromium alloy steel, etc., during the useful life of the wheel. On the other hand, the on-line wheel grinds only a single work roll material specification that is used in that stand over the life of the wheel. Therefore, grinding wheel article specifications and wheel manufacturing methods used for making a cup face planar disk wheel (Type 6A2) design cannot be translated to making a Type1 grinding wheel as their application methods are significantly different.

As mentioned earlier, grinding without chatter marks and feed marks are extremely important in grinding mill rolls. Japanese patent JP11077532 discloses a device to grind rolls without chatter. In this device, vibration sensors mounted on the grinding spindle head and the roll stand continuously monitor the vibration level during the grinding process and adjust the grinding wheel and roll rotational speeds such that it does not exceed a threshold chatter vibration level. This method, however requires that the speed ratio between the revolution speed of the grinding wheel and the revolution speed of the roll be kept constant, which adds complexity in grinding a good quality roll.

There is a need for an improved and simplified roll grinding method to grind the work rolls of various profile shapes and ferrous material specifications with a single wheel specification such that the ratio TT/WWC is greater than 10. Maximizing TT/WWC ensures significant cost savings in expensive roll materials. There is also a need for a grinding wheel having improved grinding wheel life to improve roll quality, thereby reducing the total consumable cost in the roll shop and in the strip mill.

SUMMARY

The present invention is directed to solving one or more of the problems described above. Embodiments of the invention include an improved grinding wheel and a simplified grinding method to grind a wide variety of ferrous roll materials (e.g., iron and steel alloys) and roll shapes used in hot and cold strip mills. In an embodiment, the grinding wheel is comprised of cubic boron nitride (CBN) in a bond system, having an extended grinding life such that the ratio TT/WWC may be significantly greater than 10 and the roll exhibits no substantial visual feed marks and chatter marks. In another embodiment, a method of applying the CBN grinding wheel such that a minimum grind amount less than 0.2 mm is removed from the worn roll diameter to achieve the desired geometrical and visual specification of the machined roll. In another embodiment of the invention, a method of applying a CBN grinding wheel to grind rolls without chatter and feed marks permits varying the grinding wheel speed and/or the roll speed without monitoring the vibration levels, and not having to maintain a constant speed ratio.

In an embodiment, the invention pertains to a method of grinding ferrous rolls of hardness greater than 65 SHC (Shore Hardness C measured with a Scleroscope) and having a minimum diameter of at least 10 inches and a length of at least 2 feet. In this embodiment, the method may include the steps: a) mounting the grinding wheel on a machine spindle and setting the angle between the grinding wheel rotational axis and roll rotational axis such that the axes are parallel to one another or have an inclination that is less than 25 degrees; b) bringing the rotating wheel into contact with a rotating roll surface and traversing the wheel across the axial length of the roll such that the ratio TT/WWC is greater than 10; and c) grinding the roll surface such that it is substantially free of visual feed marks and chatter marks.

In another embodiment, the invention relates to a method of grinding ferrous rolls of hardness greater than 65 SHC (Shore Hardness C measured with a Scleroscope) that includes the steps of grinding the rolls with a grinding wheel consisting essentially of a superabrasive material selected from the group of natural diamond, synthetic diamond, cubic boron nitride, or other materials with Knoop hardness greater than 3000 KHN and secondary abrasives with Knoop hardness less than 3000 KHN, in an inorganic vitrified bond or in a resin bond system, and wherein the grinding is carried out by maintaining the ratio TT/WWC greater than 10 for a surface roughness on the roll that is less than 1.25 micrometer Ra.

In one embodiment of the invention, the primary superabrasive material is cubic boron nitride (CBN) in the range of 15 to 50 volume %, in a vitrified bond or resin bond system.

In an embodiment, the invention also relates to a method of grinding rolls without visible chatter and feed marks, wherein at least one of the grinding wheel rotational speed and the roll rotational speed is varied in an amount of 1 to 40% in amplitude, with a period of 1 to 30 seconds.

BRIEF DESCRIPTION OF THE DRAWINGS

FIGS. 2A-2D are cross-section views of the different embodiments of wheel configurations of the present invention; while

FIGS. 4A and 4B are diagrams illustrating the difference in the grinding cycle between a prior art grinding wheel employing organic resin bond conventional aluminum oxide and/or silicon carbide, and one embodiment of the present invention, employing a vitrified bonded or resin bonded CBN wheel.

FIGS. 5A-5C illustrate the vibration velocity amplitude versus frequency in roll grinding operations.

DETAILED DESCRIPTION

Figure 1:
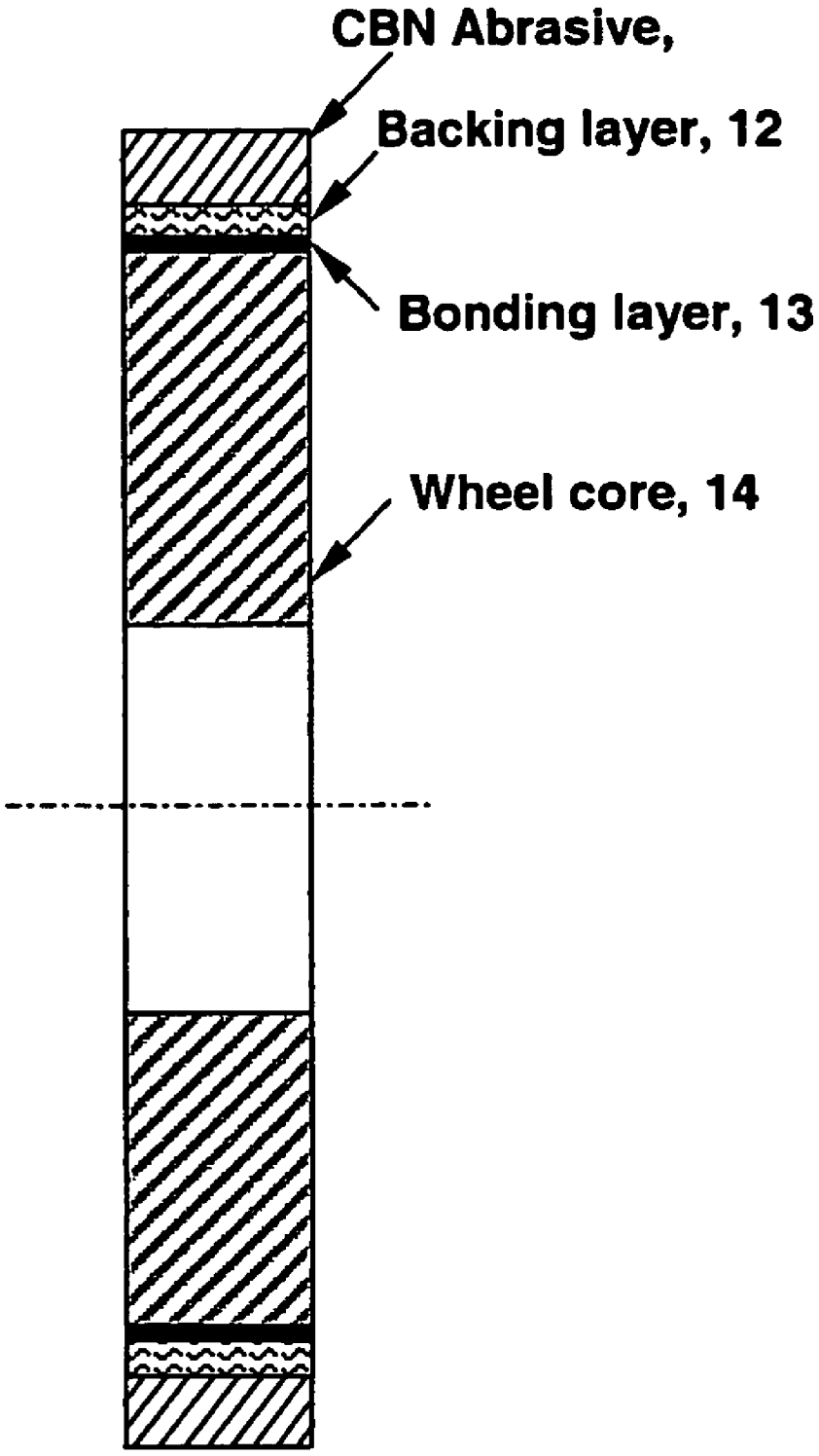
FIG. 1 is a cross-section view of one embodiment of the superabrasive wheel of the invention for use in roll grinding operations.
Figure 2A:
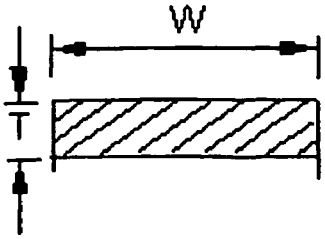
Figure 2B:
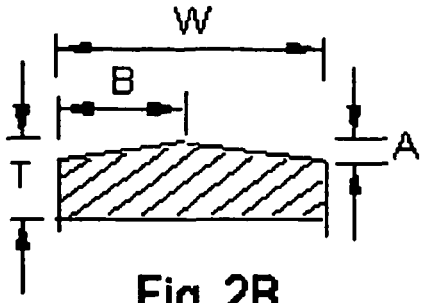
Figure 2C:
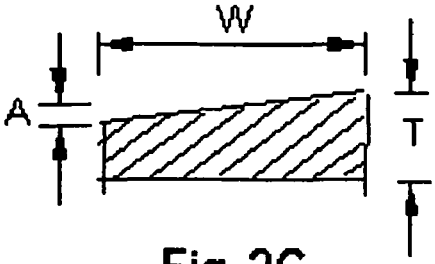
Figure 2D:
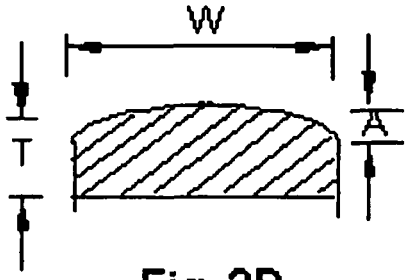
Figure 2E:
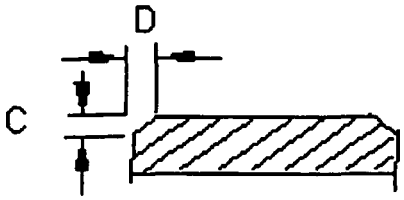
FIGS. 2E-2F are further modifications that can be applied on FIGS. 2A-2D.
Figure 2F:
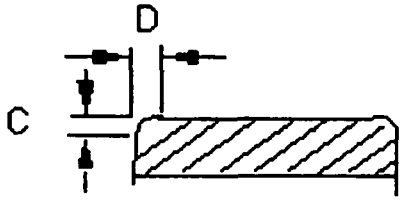

For simplicity and illustrative purposes, the principles of the invention are described by referring mainly to an embodiment thereof. In addition, in the following description, numerous specific details are set forth in order to provide a thorough understanding of the invention. It will be apparent however, to one of ordinary skill in the art, that the invention may be practiced without limitation to these specific details. In other instances, well known methods and structures have not been described in detail so as not to unnecessarily obscure the invention.

It must also be noted that as used herein and in the appended claims, the singular forms "a", "an", and "the" include plural reference unless the context clearly dictates otherwise. Unless defined otherwise, all technical and scientific terms used herein have the same meanings as commonly understood by one of ordinary skill in the art. Although any methods similar or equivalent to those described herein can be used in the practice or testing of embodiments of the present invention, the preferred methods are now described. All publications and references mentioned herein are incorporated by reference. Nothing herein is to be construed as an admission that the invention is not entitled to antedate such disclosure by virtue of prior invention.

The methods herein for use contemplate prophylactic use as well as curative use in therapy of an existing condition. As used herein, the term "about" means plus or minus 10% of the numerical value of the number with which it is being used. Therefore, about 50% means in the range of 45%-55%. In order that the invention herein described may be more fully understood, the following detailed description is set forth.

In one embodiment of the invention, an improved grinding wheel for roll-grinding applications includes an inorganic bonded grinding wheel, e.g., vitrified or ceramic bond system, wherein a superabrasive material, e.g., cubic boron nitride, is used as the primary abrasive material.

Vitrified Bond System. Examples of vitrified bond systems for use in certain embodiments of the invention may include the bonds characterized by improved mechanical strength known in the art, for use with conventional fused aluminum oxide or MCA (also referred to as sintered sol gel alpha-alumina) abrasive grits, such as those, as described in U.S. Pat. Nos. 5,203,886; 5,401,284; 5,863,308; and 5,536,283, which are hereby incorporated by reference.

In one embodiment of the invention, the vitrified bond system consists essentially of inorganic materials including but not limited to clay, Kaolin, sodium silicate, alumina, lithium carbonate, borax pentahydrate, borax decahydrate or boric acid, and soda ash, flint, wollastonite, feldspar, sodium phosphate, calcium phosphate, and various other materials which have been used in the manufacture of inorganic vitrified bonds.

In another embodiment, frits are used in combination with the raw vitreous bond materials or in lieu of the raw materials. In a second embodiment, the aforementioned bond materials in combination include the following oxides: SiO2, $Al_2O_3$, $Na_2O$, $P_2O_5$, $Li_2O$, $K_2O$ and $B_2O_3$. In another embodiment, they include alkaline earth oxides, such as CaO, MgO and BaO, along with ZnO, $ZrO_2$, F, CoO, $MnO_2$, $TiO_2$, $Fe_2O_3$, $Bi_2O_3$, and/or combinations thereof. In yet another embodiment, the bond system comprises an alkaliborosilicate glass.

In one embodiment of the invention, the bond system may include optimized contents of phosphorous oxide, boron oxide, silica, alkali, alkali oxides, alkaline earth oxides, aluminum silicates, zirconium silicates, hydrated silicates, aluminates, oxides, nitrides, oxynitrides, carbides, oxycarbides and/or combinations and/or derivatives thereof, by maintaining the correct ratios of oxides, for a high-strength, tough (e.g., resistant to crack propagation), low temperature bond.

In another embodiment, the bond system comprises at least two amorphous glass phases with the CBN grain to yield greater mechanical strength for the bond base. In another embodiment of the invention, the superabrasive wheel comprises about 10-40 volume % of inorganic materials such as glass frit, e.g., borosilicate glass, feldspar and other glass compositions.

Suitable vitreous bond compositions are commercially available from Ferro Corp. of Cleveland, Ohio, and others.

Superabrasives Component. The superabrasive material may be selected from any suitable superabrasive material known in the art. A superabrasive material is one having a Knoop hardness of at least about 3000 kg/mm$^2$, preferably at least about 4200 kg/mm$^2$. Such materials include synthetic or natural diamond, cubic boron nitride (CBN), and mixtures thereof. Optionally, the superabrasive material may be provided with a coating such as nickel, copper, titanium, or any wear resistant or conductive metal which can be deposited on the superabrasive crystal. Coated superabrasive CBN materials are commercially available from a variety of sources such as Diamond Innovations, Inc. of Worthington, Ohio, under the trade name Borazon CBN; Element Six under the trade name ABN, and Showa Denko under the trade name SBN.

In one embodiment, the superabrasives materials are monocrystalline or microcrystalline CBN particles, or any combination of the two CBN types or different toughness (see for example International patent application publication No. WO 03/043784A1). In one embodiment of the invention, the superabrasive material includes CBN of a grit size ranging from about 60/80 mesh size to about 400/500 mesh size. In yet another embodiment, the superabrasive component comprises CBN or diamond of a grit size ranging from about 80/100 mesh size to about 22-36 micron size (equivalent to about 700/800 mesh size).

In one embodiment of the invention, the superabrasive material has a friability index of at least 30. In a second embodiment, the superabrasive material has a friability index of at least 45. In a third embodiment, the superabrasive material has a friability index of at least 65. The friability index is a measure of toughness and is useful for determining the grit's resistance to fracture during grinding. The friability index values given are the percent of grit retained on a screen after friability testing. This procedure includes a high frequency, low load impact test and is used by manufacturers of superabrasive grit to measure the toughness of the grit. Larger values indicate greater toughness.

In one embodiment of the invention, the grinding wheel comprises about 10 to about 60 volume % of a superabrasive material. In a second embodiment, the primary superabrasive material is cubic boron nitride (CBN) in the range of about 20 to about 40 volume %, in a vitrified bond or resin bond system.

Examples of materials that can be used as the superabrasives component of the invention include, but are not limited to, BORAZON® CBN Type I, 1000, 400, 500, and 550 grades available from Diamond Innovations, Inc. of Worthington, Ohio, USA.

Porosity Components. The compositions of the grinding wheels of certain embodiments of the invention contain from about 10 to about 70 volume % porosity. In one embodiment, from about 15 to about 60 volume %. In another embodiment, from about 20 to about 50 vol. % porosity.

The porosity is formed by both the natural spacing provided by the natural packing density of the materials and by conventional pore inducing media, including, but not limited to, hollow glass beads, ground walnut shells, beads of plastic material or organic compounds, foamed glass particles and bubble alumina, elongated grains, fibers and combinations thereof.

Other Components. In one embodiment of the invention, secondary abrasive grains are used to provide about 0.1 to about 40 volume %, and in a second embodiment, up to 35 volume %. The secondary abrasive grains used may include, but are not limited to, aluminum oxide, silicon carbide, flint and garnet grains, and/or combinations thereof.

In manufacturing the grinding wheels containing these bonds, a small amount of organic binders may be added to the powdered bond components, fritted or raw, as molding or processing aids. These binders may include dextrins and other types of glue, a liquid component, such as water or ethylene glycol, viscosity or pH modifiers and mixing aids. Use of binders improves the grinding wheel uniformity and the structural quality of the pre-fired or green pressed wheel and the fired wheel. Because most if not all of the binders are burned out during firing, they do not become part of the finished bond or abrasive tool.

Process for Making the Superabrasive Wheel Bodies. The processes for fabricating a vitreous bond wheel is well known in the art. In one embodiment of the invention, the vitreous bond CBN abrasive layer is manufactured with or without a ceramic backing layer either by a cold pressing and sintering method or by a hot press sintering method.

In one embodiment of the cold pressing method, the vitreous bond wheel mixture is cold pressed in a mold to the shape of the wheel, and the molded product is then fired in a kiln or furnace to fully sinter the glass.

In one embodiment of the hot pressing method, the vitreous bond wheel mixture is placed in a mold and subjected to both pressure and temperature simultaneously to produce a sintered wheel. In one example, the load in the press for molding ranges from about 25 tons to about 150 tons. The sintering conditions range from about 600° C. to about 1100° C., depending on the glass frit chemistry, geometry of the abrasive layer and desired hardness in the wheel. The vitrified bonded CBN abrasive layer can be a continuous rim or a segmented rim product that is bonded or glued to a wheel body core.

The wheel core material can be metallic (examples include aluminum alloy and steel) or non-metallic (examples include ceramic, organic resin bond or a composite material), to which the active or working vitreous bonded CBN abrasive layer rim or segment is attached or bonded with an epoxy adhesive. The choice of the core material is influenced by the maximum wheel weight that can be used in the grinding machine spindle, maximum operating wheel speed, maximum wheel stiffness to grind without chatter and wheel balancing requirements to meet minimum quality grade G-1 per ANSI code S2.19.

The metallic materials used are typically medium carbon alloy steel or an aluminum alloy. The metallic core bodies are machined such that the radial and axial run out is less than 0.0005" (<0.0125 mm), and the bodies are adequately cleaned to have the vitrified bonded CBN abrasive layer bonded or glued onto them.

Non-metallic wheel body materials may have an organic resin bond or an inorganic vitreous bond including of aluminum oxide and/or silicon carbide abrasives that are pore treated with polymeric materials to resist water or grinding coolant absorption in the core. The non-metallic core material may be manufactured in the same way as an organic resin bonded grinding wheel or an inorganic vitreous bonded grinding wheel, except that they are not applied as a grinding wheel surface.

The vitreous bonded CBN abrasive layer may be attached to the non-metallic core with an epoxy adhesive, and the grinding wheel may then be finished to the correct geometry and size for the application. In one example, the fabricated wheel is finished to wheel drawing dimensions, speed tested to 60 m/s and dynamically balanced to G-1 or better per ANSI code S2.19. The grinding wheel in this invention is then applied in an off-line grinding method in roll grinding machines of the type such as made by Waldrich Siegen, Pomini, Herkules and others.

In this example, the vitrified CBN grinding wheel is mounted on a wheel adapter and fastened to the grinding spindle. The wheel is then trued with a rotary diamond disk such that the radial run-out in the wheel is less than 0.005 mm. The grinding wheel is then dynamically balanced on the machine spindle at the maximum operating speed of 45 m/s, such that the imbalance amplitude is less than 0.5 μm. It is preferable to have the grinding wheel imbalance amplitude less than 0.3 μm.

Superabrasive Grinding Wheels In one embodiment of the invention, the grinding wheel abrasive layer is employed in a configuration as illustrated in FIG. 1, which shows a cross section of a wheel, with the circular outer periphery (in the form of a ring) comprising a vitrified bond system with a superabrasive composition, e.g., CBN abrasive, sintered onto an inorganic base material such as vitrified aluminum oxide or a non ceramic material as the backing layer 12 to form a single member.

The backing layer 12 can also be a separate member made of an inorganic material or an organic material to which the CBN abrasive layer is fixed by means of an adhesive. The CBN layer itself, or together with 12 can be of a segmented design or a continuous rim member that is bonded by means of an adhesive layer 13 to the wheel core (14). In one embodiment of the invention, a segmented abrasive layer wheel design is used.

The wheel core 14 may comprise metallic or polymeric materials, and the adhesive bonding layer 13 may comprise organic or inorganic bonding materials. In another embodiment, the grinding wheel may be made without the backing layer 12.

In other embodiments of the invention, the superabrasive wheel member may be of different wheel configurations as illustrated in FIGS. 2A-2F, such as corner rounded, crowned (convex crown or concave crown), cylindrical or taper relief wheels, and the like. These configurations may be achieved through truing or by molding the abrasive segments into the desired shape with dimensions as shown in Table 1:

TABLE 1

Exemplary CBN grinding wheel configurations for roll grinding applications

| | |
|---|---|
| Wheel diameter, D | 400 mm-1000 mm |
| Wheel width, W | 6 mm-200 mm |
| CBN layer thickness, T | 3 mm-25 mm |
| Backing layer thickness, X | 0 mm-25 mm |
| A | 0.002 mm-1 mm |
| B | 0.1 W-0.9 W |
| C | 0.005 mm-3 mm |
| D | 0.005 mm-10 mm |

Figure 3:
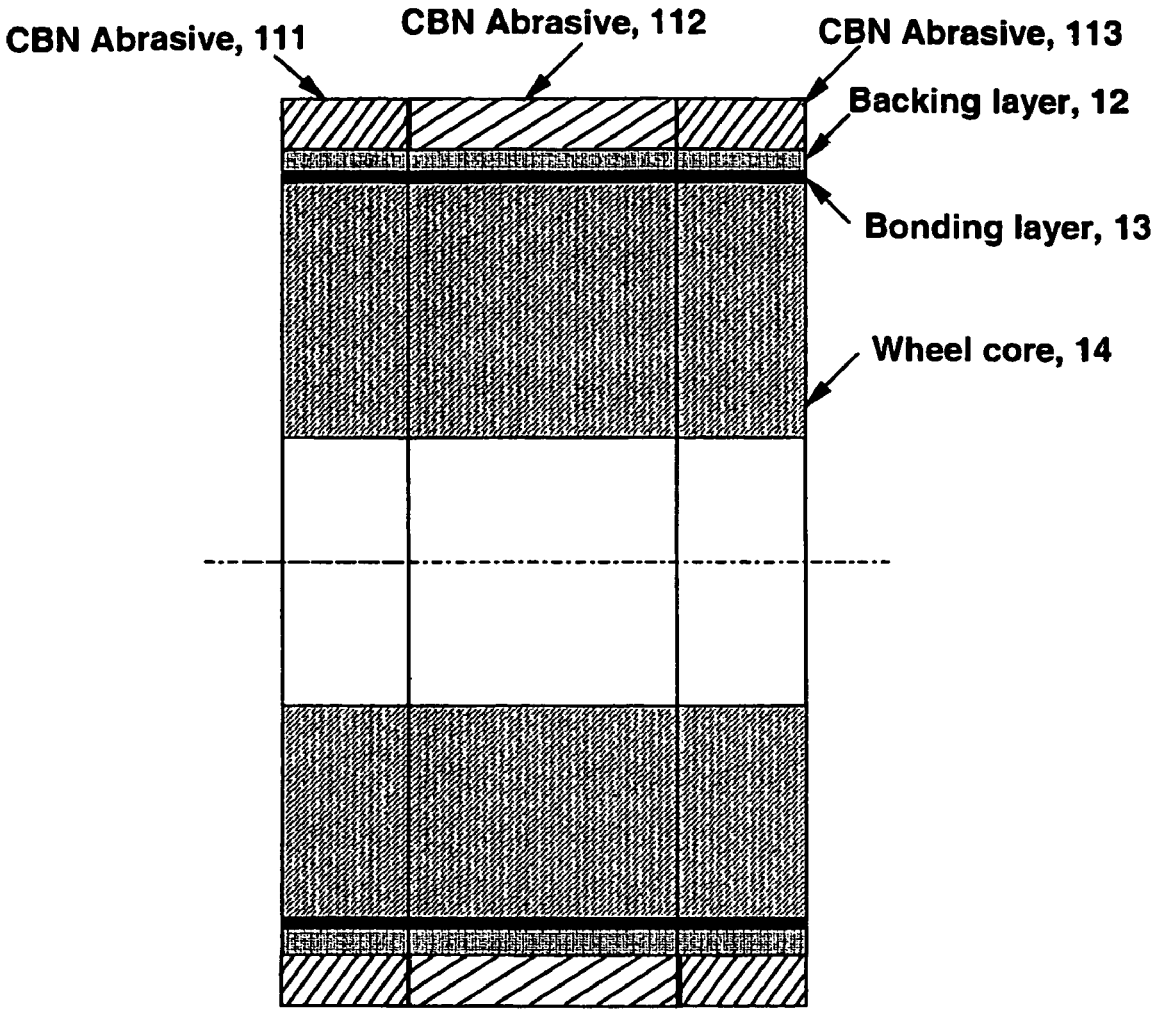
FIG. 3 is a cross-section view of one embodiment of the invention, for a superabrasive wheel having multiple sections.

In one embodiment of the invention, the grinding wheel CBN abrasive member may have a configuration as illustrated in FIG. 3 with the use of multi-section wheels having different superabrasive compositions in the abrasive layer, in an inorganic vitrified bond or organic resin bond system. The use of multiple-section wheels is illustrated with the multiple sections 111, 112, 113 in the wheel, and/or use of varying section widths. The section widths may vary from 2% up to 40% of the total wheel width (W).

In other embodiments to maximize the grinding performance, a combination of the wheel configuration (as illustrated in FIGS. 2A-2F) may be combined with multiple-section wheels having varying and optimized variables such as superabrasive compositions of different mesh sizes, or friability indices.

The changes in the mesh size and abrasive concentration may affect the relative elastic modulus of the different sections of the wheel. Thus, in some applications the use of varying mesh size CBN and concentration on the outer sections of the wheel and different section width may be optimized and/or balanced for optimal performance in terms of chatter, feed-marks and/or the ability to grind complex profiles. In one embodiment of the invention, the use of grinding wheels comprising a higher concentration of CBN or diamond provides an improved surface finish and increased life, although it may be more prone to chatter marks.

Applications of the Grinding Wheels of the Invention. In one embodiment of the invention, a CBN wheel is used to grind rolls of varying roll profile geometries, e.g., a crown roll profile or a continuous numerical profile of varying amplitude and period along the axis of the roll, in a CNC driven grinding machine such that the ratio TT/WWC is greater than 10.

It should be noted that the methods and principles of the present invention with the use of a CBN wheel, can also be applied to bond systems other than inorganic vitrified bond, e.g., resin bond CBN wheels, to achieve similar results in grinding rolls.

In another embodiment, a vitrified CBN wheel having the same wheel specification and wheel geometry as a grinding wheel of the prior art, is used to grind different work roll materials (such as iron roll, high chromium steel roll, forged HSS roll and cast HSS roll materials) at random with varying profile geometries without having to true the wheel for roll material change or a roll profile geometry change, similar to the comparative grinding wheel of the prior art.

Exemplary grinding wheels of the invention may be used to grind work rolls in strip mills, which are typically larger than 610 mm long, with a diameter of at least 250 mm. The work rolls may be of various shapes, e.g., straight cylinder, crown profile, and other complex polynomial profiles along the roll axis. They are typically ground to demanding tolerances such as: profile shape tolerance of less than 0.025 mm, taper tolerance of less than 15 nanometer per mm length, roundness error of less than 0.006 mm, and with surface finish requirements of $R_a$ less than 1.25 microns, without visible chatter marks, feed marks, thermal degradation of the roll material, and other surface irregularities such as scratch marks and heat cracks on the roll surface. In a second embodiment, the surface finish $R_a$ is less than 5 microns. In a third embodiment, the surface finish $R_a$ is less than 3 microns.

In yet another embodiment, a vitrified bonded CBN wheel is used for grinding work roll materials without any discernible chatter marks and feed marks. Chatter is suppressed by dynamically balancing the wheel in the machine and by choosing the grinding parameters such that resonant frequencies and harmonics are not generated in the system during grinding. Feed marks on the roll surface are eliminated by varying the grinding wheel traverse rates in each grinding pass and/or varying the material removal rates for each grinding pass.

In another embodiment, the roll chatter is suppressed by inducing a controlled variation in the vitrified bonded CBN wheel and/or work roll rotational speed amplitude and period during the grinding process, wherein the ratio of the grinding wheel speed to the roll speed is not constant.

FIGS. 4A and 4B are illustrations showing the difference in the grinding cycle between a prior art wheel comprising conventional aluminum oxide and/or silicon carbide in a organic resin bond system, and a CBN bonded grinding wheel of an embodiment of the invention, respectively.

As illustrated in FIG. 4A, grinding wheel W that is in contact with the roll surface R at position A1 is advanced to a depth of A2 (corresponding to wheel radial end in-feed EI=A1 minus A2) and traversed along the axis of the roll to position B1 at the other end of the roll. Since the comparative prior art wheel wears continuously in going from A2 to B1, a wheel wear compensation (WWC) is added to the grinding wheel head slide to compensate for the decrease in wheel radius, such that the net result of removing stock along the work roll is equal to the end in-feed amount EI. The tool path T1 illustrates the wheel wear compensation that is applied, with the magnitude being equal to A2 minus B1. After the wheel reaches position B1, the grinding wheel is further advanced to position B2 and traversed to position A3, with wheel wear compensation along tool path T2. The procedure is applied back and forth until the work roll is finished to geometric tolerance. In the roll grinding practice of the prior art, the ratio TT/WWC typically ranges from 0.25 to 5 for a roll taper tolerance of 0.025 mm.

FIG. 4B illustrates one embodiment of the present invention with a vitrified bonded CBN wheel, and with zero or minimal wheel wear compensation that is less than 1 nanometer per mm length of the roll. Grinding wheel W that is in contact with the roll surface R is given an end in-feed amount EI=A1 minus A2, and traversed along the axis of the roll to position B1. As illustrated, the tool path T1 is straight and requires little, if any, wheel wear compensation, as the grinding wheel in this invention removes stock uniformly along the axis of the work roll corresponding to the end in-feed amount EI. At wheel position B1, the grinding wheel is further advanced into the roll surface to position B2 and traversed along the roll to position A3. The tool path T2 is parallel to T1 and does not involve wheel wear compensation. This process is repeated until the wear amount in the work roll is removed and the desired work roll geometry is achieved. The ratio of TT/WWC in this embodiment is greater than 10.

In one embodiment of the invention for a roll taper tolerance of 0.025 mm, the ratio TT/WWC is greater than 10 (compared to a ratio less than 3 as disclosed in US Patent Publication No. 20030194954). In a second embodiment of the invention, the ratio TT/WWC is greater than 25. In yet a third embodiment of the invention, the ratio of TT/WWC is greater than 50.

In one embodiment of a roll grinding operation, the grinding wheel is dynamically balanced on the grinding machine spindle to imbalance amplitude of less than 0.5 μm at the operating speed. The operating speed may range from 20 m/sec to 60 m/sec. The superabrasive wheels of the invention may be used in hot and cold roll grinding of iron and steel (ferrous materials in general) rolls, optionally of hardness greater than 65 SHC, such as those used in the steel, aluminum, copper and paper industries. The angle between the grinding wheel rotational axis and the roll rotational axis is preferably about 25 degrees or less and optionally, close to zero degrees, although other angles are possible. The wheels may be used to grind rolls of different profiles, including but not limited to straight rolls, crowned rolls, and continuous numerical profile rolls to meet geometrical and size tolerances such that the ratio of TT/WWC is greater than 10.

The extremely high wear resistance of the superabrasive materials, e.g., CBN, ensures that the amount of stock removed will be very close to the theoretical (applied) stock removal. Therefore in one embodiment of the invention, the amount of roll grinding stock removed using CBN grinding wheels is set so as to minimize loss of roll material, while achieving the roll profile tolerance at the same time. This is accomplished by setting the roll stock to be removed based on the initial wear profile of the roll and radial run-out in the roll.

In one embodiment, the roll grinding process is set up so as to utilize the highest possible grinding wheel speed without causing adverse wheel imbalance during both roughing and finishing passes, e.g., grinding wheel speed from 18 m/s to 60 m/s for CBN wheels with diameters up to 30". In another embodiment with CBN wheels having diameters ranging from 30" to 40", the grinding wheel speed is limited to 45 m/s based on machine design and safety limit in the roll grinding machine. In yet another embodiment of roll grinding machines employing CBN grinding wheels greater than 30" in diameter, the grinding speeds are set to be greater than 45 m/s. The work (roll) speeds may be selected such that the traverse rates can be maximized. The grinding wheel speed and traverse rates speeds may be lowered in the finishing passes in order to achieve a roll surface that is free of feed marks and chatter marks, and still meets surface roughness requirements.

In one embodiment, the work speeds used for roll grinding employing the superabrasives wheels are in the range of 18 m/min up to 200 m/min. In another embodiment of grinding wheels comprising CBN in an inorganic vitrified bond system, the wheel performance in terms of Grinding ratio (G) range from 35 to 1200, for grinding a combination of roll materials ranging from chilled iron to high speed steel rolls. This is compared to the typical Grinding ratio (G) in the prior art wheels employing aluminum oxide, of 0.5 to 2.093. The roll grinding process can be accomplished using multiple passes with fast traverse across the roll (traverse grinding) or in a single pass with large depth of cut using slow traverse rates (creep-feed grinding). Substantial reduction in cycle time can be obtained by using creep-feed grinding method for roll grinding.

In one embodiment of the roll grinding operation, a minimum amount of stock is removed off the work roll to bring the roll into the correct profile geometry from the worn condition, with the stock removed on the roll diameter being less than about 0.2 mm (plus roll wear) compared to a removal greater than 0.25 mm (plus roll wear) with a prior art wheel employing aluminum oxide in an organic resin bond. Preferably, stock removal is less than about 0.1 mm, less than about 0.05 mm, and even more preferably, less than about 0.025 mm. This represents an increase of at least 20% in useful roll usage in the hot strip mill before being replaced by a new roll.

In another embodiment of the invention, an increase in surface quality may be achieved by eliminating chatter marks and/or feed marks by controlling the grinding wheel rotational frequency amplitude and period, and/or by controlling the work roll rotational frequency amplitude and period continuously during the grinding process.

In yet another embodiment of the invention, the roll grinding operation employing the vitrified CBN wheel of the invention can be carried out with minimal or no profile error compensation and taper error compensation. In the event that compensation is needed, profile error compensation and taper compensation are applied only to correct for roll misalignments in the machine or temperature variations in the machine system or due to other roll errors such as axial and radial run-out when mounted in the machine.

EXAMPLES

Examples are provided herein to illustrate the invention but are not intended to limit the scope of the invention. In some of the examples, grinding performance of one embodiment of the inorganically bonded vitrified CBN of the invention is compared against a commercially available and representative state of the art conventional abrasive (aluminum oxide or a mixture of aluminum oxide and silicon carbide as the primary abrasive material) grinding wheel that is used in a production roll grinding shop.

Test Wheel Data: In Examples 1 and 2, the comparative wheels C1 are type 1A1 wheels with 32" Diameter×4" Wide× 12" Hole. It should be noted that conventional abrasive roll grinding wheels typically have a minimum useful diameter of 24".

The wheels of this example have a dimension of 30" D×3.4" W×12" H, with ⅛" thick useful CBN layer, segmented CBN abrasive layer design bonded to an aluminum core. Three commercial vitrified CBN grinding wheels made to formulations specified by Diamond Innovations, Inc. of Worthington, Ohio, are used for the wheels of this example for the evaluation:

CBN-1: Borazon CBN Type-I, low concentration, medium bond hardness

CBN-2: Borazon CBN Type-I, high concentration, high bond hardness

CBN-3: Borazon CBN Type-I, high concentration, high bond hardness.

The vitrified CBN wheels in the examples are trued with a rotary diamond disk, such that the radial run-out is less than 0.002 mm (in some runs, less than 0.001 mm) under the following conditions:

Device: ½ HP Rotary powered dresser

Wheel type: 1A1 metal bond diamond wheel

Diamond type: MBS-950 from Diamond Innovations, Inc. of Worthington, Ohio.

Wheel size: 6.0" (OD)×0.1" (W)

Wheel speed: greater than 18 m/s

Dress speed ratio: 0.5 unidirectional

Lead/rev: 0.127 mm/rev

Infeed/pass: 0.002 mm/pass

After truing, the vitrified CBN wheels are dynamically balanced on the grinding spindle at a wheel speed of 45 m/s and imbalance amplitude less than 0.5 μm (preferably less than 0.3 μm).

The comparative wheel C-1 is trued with a single point diamond tool as per the normal practice in the industry. The comparative wheel is also balanced to the same extent as with the vitrified CBN wheels of the invention in the tests.

Example 1

Grinding Performance of Iron Rolls

In this example, the roll grinding comparison tests are conducted on a 100 HP Waldrich Siegen CNC roll grinding machine wherein the grinding wheel rotational axis is substantially parallel to the roll rotational axis, such that the angle is less than about 25 degrees. The dimensions of the iron roll are 760D×1850L, mm. A synthetic water soluble coolant at 5V % concentration is applied during grinding. The coolant flow rate and pressure conditions are the same for the conventional wheel and the vitrified CBN wheel in this evaluation. The hardened iron rolls have a radial wear amount of 0.23 mm that has to be corrected in the grinding operation such that the taper tolerance is less than 0.025 mm and profile tolerance is less than 0.025 mm. The grinding conditions for the comparative conventional wheel and the vitrified CBN wheel are nearly equivalent for wheel speed, traverse rate, work speed and depth of cut per pass. The grinding results are given below in Table 2.

TABLE 2

| | Comparative wheel C-1 | Vitrified CBN wheels CBN-1, CBN-2, CBN-3 |
|---|---|---|
| Grind Parameters | | |
| Roll material | Hardened Iron 70 SHC | Hardened Iron 70 SHC |
| TT/WWC mm | 0.5-5 | >2000 |
| # of work rolls ground | 4 | 4 |
| Grinding Results: | | |
| Avg. Stock removed on diameter, mm | 0.4 | 0.2 |
| Max. Grinding Power, kW/mm | 0.45 | 0.29 |
| Crown profile and taper quality | Within spec | Within spec |
| Chatter and Feed marks | Within spec | Within spec |
| Visual Scratch marks | Within spec | Within spec |
| Surface roughness, Ra | Within spec | Within spec |
| Thermal degradation | Within spec | Within spec |
| Grinding Ratio, G | Wheel C1 = 2.62 | CBN-1 = 100<br>CBN-2 = 400<br>CBN-3 = >2000 |

As shown in the table, for the grinding wheels of this example, CBN-1, CBN-2 and CBN-3 produce a very high grinding ratio G, ranging from 38 times to 381 times that of the comparative wheel C-1 of the prior art. Also, the ratio of TT/WWC for CBN grinding wheels are 400 times greater than that of the comparative wheel for grinding the rolls to specification.

Also as shown, the maximum grinding power per unit width of the wheel for CBN wheels are 35% lower than the comparative wheel. The results also show that 50% less stock removal is required with the CBN wheels compared to the comparative wheel of the prior art to correct the roll to the desired geometry. This reduced stock removal increases the useful service life of the iron roll by 50%; a significant cost savings to the roll mill.

Example 2

Grinding Performance of Forged HSS Rolls

In this example, the same wheels in Example 1 are used to grind a forged HSS work roll having a complex polynomial profile along the axis of the roll.

The wheels are not trued and are continued in the same condition after grinding the hardened iron rolls on the same grinding machine. The HSS work rolls have an initial radial wear of 0.030 mm and have to be ground such that the taper and profile shape tolerances are less than 0.025 mm. The grinding conditions in terms of the wheel speed, work speed, traverse rate and depth of cut are equivalent for both the comparative wheel and the vitrified CBN wheel. The dimensions of HSS roll used are 760.5D×1850L, mm.

The grinding conditions and results are given below in Table 3.

TABLE 3

| | Comparative wheel C-1 | Vitrified CBN wheel CBN-1, CBN-2, CBN-3 |
|---|---|---|
| Grind Parameters | | |
| Roll material | Forged HSS, 80 SHC | Forged HSS, 80 SHC |
| TT/WWC | 0.5-5 | >2000 |
| # of work rolls ground | 4 | 4 |
| Grinding Results: | | |
| Avg Stock removed on diameter, mm | 0.35 | 0.2 |
| Max. Grinding Power, kW/mm | 0.5 | 0.35 |
| Profile and taper quality | Within spec | Within spec |
| Visual Chatter and Feed marks | Within spec | Within spec |
| Visual Scratch marks | Within spec | Within spec |
| Surface roughness, Ra | Within spec | Within spec |
| Thermal degradation | Within spec | Within spec |
| Grinding Ratio, G | Wheel C1 = 1.27 | CBN-1 = 35<br>CBN-2 = 200<br>CBN-3 = 1000 |

In grinding the HSS rolls, the grinding ratio G for CBN-1, CBN-2 and CBN-3 wheels range from 27 to 787 times that of the comparative wheel C-1 with organic resin bond conventional abrasives. The ratio of TT/WWC is at least 400 times greater for CBN grinding wheels than that of the comparative wheel to grind the rolls within specification. The maximum grinding power per unit width of grind for all three CBN wheel is 30% less than that of the comparative wheel C-1. It is also observed that less stock removal is required by the vitrified CBN wheel to finish the worn work roll to the final desired geometry. The HSS roll life can thus further be extended by at least 35%, resulting in significant roll cost savings to the roll mill and the roll shop.

Thus, multiple roll materials may be efficiently ground with the inorganic vitrified bonded CBN wheel of the invention, in this example providing extended wheel life by more than two orders of magnitude over the prior art practice employing an organic resin bonded wheel containing conventional abrasives as the primary abrasive material.

Example 3

Chatter Suppression Method for a Vitrified CBN Wheel

In this example, the effect of wheel rotational speed variation to the vitrified bonded CBN wheel during the grinding process to suppress chatter is demonstrated. Since the inorganic vitrified bond CBN system typically has a high E-modulus (10-200 GPa), compared to the prior art organic resin bonded wheels (E-modulus between 1-10 GPa) and the rate of wear of CBN wheel of the invention is quite low, the machine harmonics due to self excited vibration during grinding are readily observed in the roll as chatter marks at distinct harmonic frequencies of the machine system.

As illustrated in FIGS. 5A-5C, Applicants have surprisingly discovered that it is possible to avoid discernible chatter marks by dissipating the harmonic amplitudes over a wider frequency spectrum, instead of being concentrated at certain frequencies.

In one example, a piezoelectric accelerometer is mounted on the grinding machine spindle bearing housing and the vibration generated during the grinding process is monitored. FIG. 5A shows the vibration velocity amplitude versus frequency measured when grinding a work roll with a vitrified CBN wheel of the invention, at a wheel speed of 942 rpm. The vibration amplitudes are concentrated at 3084, 4084 and 5103 cycles per minute. The vibration velocity magnitude is a maximum at 0.002 ips at 4084 cpm.

In FIG. 5B, the grinding wheel spindle rpm amplitude is fluctuated by 10% at a period of 5 seconds. It is seen that the vibration velocity is slightly decreased and is dispersed over a broader frequency instead of being concentrated.

In FIG. 5C, the spindle rpm is fluctuated at amplitude of 20% and a period of 5 seconds. It is seen that the vibration velocity amplitude is further decreased to less than 0.001 ips, and is distributed over a broader frequency range with no distinct harmonics.

In one embodiment of the method of the invention, this spindle speed variation technique is employed in conjunction with the vitrified bonded CBN wheel to suppress chatter. The spindle speed variation technique herein is applied at a speed variation amplitude between 140% and at a period from 1 to 30 seconds during the grinding process. The speed variation may be in the grinding wheel rotational speed, the work roll speed, or in both speeds. In one example, the technique is applied with a wheel rotational frequency (rpm) variation at an amplitude of ±20% with a period of 5 seconds.

In another embodiment, chatter suppression is obtained by fluctuating the work roll speed independently or simultaneously with the grinding wheel speed fluctuation. In a third embodiment, chatter suppression is surprisingly obtained by using the spindle speed variation technique in conjunction with a conventional grinding wheel of the prior art, i.e., a wheel employing primarily conventional abrasives.

Table 4 is a summary of results obtained in grinding a wide variety of roll materials (8 iron rolls, 4 forged HSS rolls and 4 cast HSS rolls) using one embodiment of the wheel of the present invention, CBN-2, in a typical production environment.

TABLE 4

| Grinding results | Comparative wheel C-1 | Vitrified CBN wheel CBN-2 |
|---|---|---|
| Average stock removed on diameter, mm | 0.35 | 0.2 |
| Max. Grinding Power, kW/mm | 0.5 | 0.35 |
| Profile and taper quality | Within spec | Within spec |
| Chatter and feed marks | Within spec | Within spec |
| Scratch marks | Within spec | Within spec |
| Surface roughness, Ra | Within spec | Within spec |
| Thermal degradation | Within spec | Within spec |
| Average Grinding Ratio, G | 1.27 | 200 |

The results in Table 4 demonstrate the performance capability of the CBN wheel in this example to grind a wide variety of roll materials in a significantly more efficient manner than the comparative wheel of the prior art. The results show that the rolls can be ground with CBN-2 to finished roll specifications with over 40% reduction in average stock removed and with 30% less grinding power relative to comparative wheel C-1. In addition the grinding ratio G for CBN-2 is at least 150 times that of the comparative wheel C-1.

While the invention has been described with reference to a preferred embodiment, those skilled in the art will understand that various changes may be made and equivalents may be substituted for elements thereof without departing from the scope of the invention. It is intended that the invention not be limited to the particular embodiment disclosed as the best mode for carrying out this invention, but that the invention will include all embodiments falling within the scope of the appended claims.

All citations referred herein are expressly incorporated herein by reference.

We claim:

1. A method of grinding a ferrous roll having a rotating roll surface with a rotating grinding wheel, the ferrous roll having a hardness greater than 65 SHC and a minimum diameter of at least 10 inches and a length of at least 2 feet, the method comprising:

a) mounting a grinding wheel on a machine spindle and setting an angle between the grinding wheel rotational axis and roll rotational axis less than about 25 degrees;

b) bringing the rotating wheel into contact with the rotating roll surface and traversing the wheel across an axial roll length of the roll, while maintaining a ratio of axial taper tolerance (TT) to radial wheel wear compensation (WWC) of greater than 10; and c) grinding the roll surface to a surface roughness $R_a$ of less than 5 micrometer while leaving the roll surface substantially free of feed marks, chatter marks, and surface irregularities.

2. The method of claim 1, wherein the roll is ground to a surface roughness $R_a$ of less than 3 micrometer.

3. The method of claim 1, wherein the ferrous roll surface is substantially free of thermal degradation.

4. The method of claim 1, wherein the ratio of TT to WWC is greater than 25.

5. The method of claim 1, wherein said grinding wheel includes a layer comprising of a superabrasive material having a Knoop hardness greater than 3000 KHN, selected from the group of natural diamond, synthetic diamond, cubic boron nitride, and mixtures thereof, with or without a secondary abrasive with Knoop hardness less than 3000 KHN, in a bond system.

6. The method of claim 5, wherein the superabrasive material comprises cubic boron nitride, and the amount of cubic boron nitride in said grinding wheel bond system is in the range of 10 to 60 volume %.

7. The method of claim 5, wherein the bond system is one of: a) a vitrified bond comprising at least one of clay, feldspar, lime, borax, soda, glass frit, fritted materials and combinations thereof; and b) a resin bond system comprising at least one of a phenolic resin, epoxy resin, polyimide resin, and mixtures thereof.

8. The method of claim 1, wherein the grinding wheel is rotated from 3600 to 12000 fpm.

9. The method of claim 1, wherein said method further comprises the step of removing stock off the ferrous roll in one pass or multiple passes.

10. The method of claim 1, wherein the grinding is carried out at a G ratio of at least 20.

11. The method of claim 1, wherein the grinding wheel has an axis of rotation that is substantially parallel to the rotational axis of the roll.

12. The method of claim 1, wherein said ferrous roll is a solid revolution having a surface geometry selected from one of: a convex crown, a concave crown, a continuous numerical profile, and a polynomial shape along the axis of the roll, ground to a form profile tolerance of less than 0.05 mm.

13. The method of claim 1, wherein said grinding wheel has a traverse rate of at least 50 mm/min.

14. The method of claim 1, wherein said grinding wheel removes a stock grind amount of less than about 0.2 mm from the minimum worn roll diameter.

15. A method of grinding a ferrous roll having a rotating roll surface with a rotating grinding wheel, the method comprising:

a) mounting the grinding wheel on a machine spindle;

b) bringing the rotating wheel into contact with the rotating roll surface and traversing the wheel across an axial roll length of the roll; and c) grinding the roll surface while at least one or both of said grinding wheel rotational speed and said mill roll rotational speed is varied in an amount of +/−1 to 40% in amplitude, with a period of 1 to 30 seconds;

wherein a ratio of TT to WWC is greater than 25.

16. The method of claim 15, wherein the bond system is one of: a) a vitrified bond comprising at least one of clay, feldspar, lime, borax, soda, glass frit, fritted materials and combinations thereof; and b) a resin bond system comprising at least one of a phenolic resin, epoxy resin, polyimide resin, and mixtures thereof.

* * * * *